US009091076B2

(12) United States Patent
Amer et al.

(10) Patent No.: US 9,091,076 B2
(45) Date of Patent: Jul. 28, 2015

(54) TOILET FLANGE TEMPLATE APPARATUS

(71) Applicants: Jack Amer, Cerritos, CA (US); Danny Alvarez, Cerritos, CA (US)

(72) Inventors: Jack Amer, Cerritos, CA (US); Danny Alvarez, Cerritos, CA (US)

( * ) Notice: Subject to any disclaimer, the term of this patent is extended or adjusted under 35 U.S.C. 154(b) by 0 days.

(21) Appl. No.: 14/096,027

(22) Filed: Dec. 4, 2013

(65) Prior Publication Data

US 2015/0152648 A1 Jun. 4, 2015

(51) Int. Cl.

| | |
|---|---|
| ***G01B 3/14*** | (2006.01) |
| ***E04F 15/02*** | (2006.01) |
| ***E04F 21/00*** | (2006.01) |

(52) U.S. Cl.

CPC ..... *E04F 15/02177* (2013.01); *E04F 21/0076* (2013.01)

(58) Field of Classification Search

CPC . E04F 15/02177; E04F 21/20; E04F 21/0076; G01B 3/14

USPC ..... 33/526, 529, 562, 565, 613, 645, 27.01

See application file for complete search history.

(56) References Cited

U.S. PATENT DOCUMENTS

| | | | | |
|---|---|---|---|---|
| 2,835,981 | A * | 5/1958 | Kaufman | 33/529 |
| 4,233,697 | A | 11/1980 | Cornwall | |
| 4,967,422 | A | 11/1990 | Novak | |
| 5,188,013 | A * | 2/1993 | Cardinale | 33/527 |
| 5,996,134 | A | 12/1999 | Senninger | |
| 6,085,362 | A | 7/2000 | Huber | |
| 6,799,606 | B1 | 10/2004 | Howson | |
| 8,099,801 | B2 | 1/2012 | Hughes | |
| 2008/0022542 | A1 * | 1/2008 | Brosmith et al. | 33/562 |
| 2009/0265947 | A1 * | 10/2009 | Sanders | 33/645 |
| 2011/0131715 | A1 | 6/2011 | Culwell | |
| 2012/0240319 | A1 | 9/2012 | Yssel | |
| 2013/0167292 | A1 | 7/2013 | Mchugh, III | |
| 2014/0223753 | A1 * | 8/2014 | Yaphe et al. | 33/566 |
| 2014/0230361 | A1 * | 8/2014 | Wood | 33/526 |
| 2014/0237836 | A1 * | 8/2014 | Yaphe et al. | 33/528 |

* cited by examiner

*Primary Examiner* — G. Bradley Bennett

(74) *Attorney, Agent, or Firm* — John D. Tran; Rhema Law Group

(57) ABSTRACT

A toilet flange template apparatus comprising a first arm having a first head and a first connecting member extending therefrom, the first head defining a first perimeter edge substantially corresponding to and providing circumferential clearance relative to a toilet flange, and a second arm having a second head and a second connecting member extending therefrom, the second arm being pivotally connected to the first arm, the second head formed having a substantially downwardly-extending second center boss configured to be received within the toilet flange.

15 Claims, 9 Drawing Sheets

TOILET FLANGE TEMPLATE APPARATUS

RELATED APPLICATIONS

Not Applicable.

INCORPORATION BY REFERENCE

Applicant(s) hereby incorporate herein by reference any and all patents and published patent applications cited or referred to in this application.

FIELD OF THE INVENTION

Aspects of this invention relate generally to tools, and more particularly to a tool for assisting with installing flooring around a toilet flange.

DESCRIPTION OF RELATED ART

By way of general background, it is customary in the art of building construction, whether commercial or residential, to install new flooring in bathrooms and the like, such flooring most often involving tile of various kinds. The installer must cut the tile or other flooring around not only all walls and other obstructions but also around any plumbing fixtures on the floor and even adjacent walls depending the design and intended installation of the tile or other material. One specific challenge that arises in such contexts is cutting an opening in the tile or tiles about the toilet flange or closet flange, or the pipe formed in and extending slightly upwardly from the floor over which a toilet is typically installed, so as to provide clearance for such flange while substantially covering the floor thereabout, and particularly enough of the floor such that the later-installed toilet will sit substantially level or flush with the floor while leaving none of the subfloor exposed beyond the perimeter of the toilet base. As such, it is desirable to be able to cut a substantially circular, arcuate or other such opening in the one or more tiles that will surround the toilet flange before they are secured to the floor, such that the resulting opening in the tile(s) when laid approximates the toilet flange perimeter. What has been needed and has heretofore been unavailable is a means for marking flooring around a toilet flange to increase accuracy and efficiency.

The following art defines the present state of this field:

U.S. Pat. No. 4,233,697 to Cornwall is entitled "Protective flange cover and method of use" and is directed to a protective cover or cap for connection to a toilet mounting flange installed on a drain or discharge pipe. The cover protects the stems of bolts for connecting the flange to the toilet by means of at least two tubular extensions on the cover which surround the bolts and by means of nuts over washers on the bolt stems when the cover is installed on the flange. The cover makes it much easier to align the flange visually with the surrounding walls by means of the tubular extensions for the bolts. In addition, the cover is adapted for hydrostatic testing of the drainage system, prevents any foreign material from entering the discharge pipe and protects the slots and holes in the flange from becoming clogged or filled.

U.S. Pat. No. 4,967,422 to Novak is entitled "Closet flange protector" and is directed to a closet flange protector to protect and overlie a water closet flange and test plugs during a construction proceeding. The protector includes an inverted cup-shaped member including an upper disk portion provided with spaced diametrically opposed wells. A downwardly depending skirt depends downwardly from the disk and associated wells terminating in a continuous conical skirt. The conical skirt and wells include aligned through extending apertures for receiving diametrically opposed threaded bolts. The bolts include threaded fasteners received within the wells to secure the well to a floor structure and overlie an associated water closet flange.

U.S. Pat. No. 5,996,134 to Senninger is entitled "Cover, spacer and plumbing installation assembly" and is directed to a plumbing installation assembly including a closet flange and a cooperating spacer and cover. The spacer holds the closet flange above the floor a selected height to allow the pouring of lightweight concrete. The cover fully covers the face and slotted mounting apertures in the closet flange upon which the toilet is mounted.

U.S. Pat. No. 6,085,362 to Huber is entitled "Water closet fitting installation assembly" and is directed to a water closet fitting installation assembly for installation and optional testing of a water closet fitting within a poured, permanently set floor. The assembly permits the fitting to be rapidly and efficiently installed flush with the floor surface, without risk of fouling the drainage system or blocking drainage of water from the system with slopped or mispoured floor material such as concrete; facilitates mounting and placement of a water closet stool. Optionally the system further facilitates pressure testing of the drain system after the fitting has been installed, without the necessity of placing permanent structures or other blockages in the drain system. The assembly comprises a water closet fitting; a flange adapted for rotatable engagement of an outer circumference of the fitting, whereby a water closet stool may be attached to the fitting in a desired rotational orientation relative to the fitting by means of mechanical fasteners passing through holes in the flange; a collar adapted to prevent contact between the flange, the fitting, and mechanical fasteners used to mount the stool and the material in which the fitting is installed; and a temporary or removable cover plate adapted to cover the fitting and to prevent unset flooring material from entering the water closet fitting or the drain system on installation, so that the fitting and said the system are kept free from the material, and from potential blockage thereby. Preferred embodiments of the fitting assembly further comprise a test baffle adapted to permit the water closet drain system to be tested for fluid tight integrity after the water closet fitting has been installed, without fouling the drain system with the test baffle or pieces thereof after the test has been completed.

U.S. Pat. No. 6,799,606 to Howson is entitled "Drainage pipe covering kit for use during building or floor construction" and is directed to an accessory for use in construction including a conduit (12) that has an inlet end (34) portion and an outlet end (18) portion. The outlet end (18) portion is mountable on a drainage pipe (22) so that the conduit (12) and the drainage pipe (22) are in fluid communication with each other. A removable closure member (40) is mounted on the inlet end (34) portion to close the conduit (12) when not in use or during building construction, so that ingress of material or detritus into the drainage pipe (22) is inhibited.

U.S. Patent Application Publication No. 20110131715 to Culwell is entitled "Water Closet Flange Seal" and is directed to an improved method of installing a closet flange that allows installation of plumbing fixtures with a reduced likelihood of leaks. The method involves telescopically fitting an inner or outer surface of a drainpipe to a surface of a cylindrical portion of a hub of a closet flange, where the hub has a base flange extending therefrom; and securing the base flange against the upper surface of a subfloor. A first layer of sealant is applied to an upper surface of the base flange; and a flooring membrane is secured to the upper surface of the base flange by the first layer of sealant. A second layer of sealant is applied to an upper surface of the flooring membrane; and the upper surface of the flooring membrane is clamped between the base flange and a clamping ring. The method may be performed using a two-part closet flange for connection to a drain pipe for a toilet. The two-part closet flange comprises a cylindrical hub adapted to telescopically connect to the drain pipe; an annular flange radially extending from the cylindrical hub; a clamping ring; and a means to clamp a flooring membrane between the clamping ring and the annular flange.

U.S. Pat. No. 8,099,801 to Hughes is entitled "Closet flange system for existing installation" and is directed to a system which includes a closet flange insert and at least one spacer to be positioned between the closet flange insert and an installed closet flange. The closet flange insert includes a toilet connecting flange which extends radially outwardly from a through pipe. The through pipe is sized to be inserted into a pipe section of a closet flange. Each spacer includes spaced apart first and second faces, and spaced apart inner and outer edges extending between the first and second faces. The inner edge defines an opening extending through the body, the opening sized to permit passage therethrough of the through pipe of the closet flange insert but not the toilet connecting flange of the closet flange insert. Advantageously, with the subject invention, a system is provided which allows the closet flange insert to be mounted atop an installed closet flange, with one or more spacers therebetween, and with the closet flange insert being flush with surrounding finished flooring.

U.S. Patent Application Publication No. 20120240319 to Yssel is entitled "Toilet Flange Assembly With Cover" and is directed to a toilet flange provided with a planar perimeter portion to assist the installer in accurately determining the distance to an adjacent wall as well as insuring the toilet fastening bolts are aligned parallel thereto. The toilet flange assembly includes a cover to store needed fastening elements while simultaneously preventing debris from entering the plumbing riser pipe. Additionally, a sleeve is provided that protects the threads of the toilet fastening bolts during construction and acts as an extendable flexible guide sleeve. The guide sleeve functionally extends the height of the toilet fastening bolt thereby assisting the toilet installer as a visual aid during installation.

U.S. Patent Application Publication No. 20130167292 to McHugh is entitled "Template for Closet Flange" and is directed to templates, methods, and kits for installing closet flanges. The template can include a body having a sidewall and a bottom as well as a plurality of tabs connected to the body, with one or more of the tabs configured to delineate the location of a fastener hole in a closet flange.

The prior art described above teaches a protective flange cover and method of use, a closet flange protector, a cover, spacer and plumbing installation assembly, a water closet fitting installation assembly, a drainage pipe covering kit for use during building or floor construction, a water closet flange seal, a closet flange system for existing installation, a toilet flange assembly with cover, and a template for closet flange, but does not teach an apparatus that enables locating a portion thereof substantially centered on the toilet flange even when a tile is placed over the toilet flange so as to thereby enable relatively convenient and accurate marking of a hole cut-out location on the tile substantially corresponding to and providing clearance about the toilet flange. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing a new and novel toilet flange template apparatus. The apparatus provides, in the exemplary embodiment, a first arm having a first head and a first connecting member extending therefrom, the first head defining a first perimeter edge substantially corresponding to and providing circumferential clearance relative to a toilet flange, and a second arm having a second head and a second connecting member extending therefrom, the second arm being pivotally connected to the first arm, the second head formed having a substantially downwardly-extending second center boss configured to be received within the toilet flange.

A primary objective inherent in the above described apparatus and method of use is to provide advantages not taught by the prior art.

Another objective is to provide such an apparatus that enables locating the first head substantially centered on the toilet flange even when a tile is placed over the toilet flange, in at least one embodiment.

A further objective is to provide such an apparatus that upon positioning the second center boss within the toilet flange and placing a tile between the first and second arms in a desired location on a subfloor, marking the tile along the first perimeter edge so as to define a hole to be cut in the tile is enabled substantially corresponding to and providing circumferential clearance relative to the toilet flange for subsequent installation of the tile thereabout.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
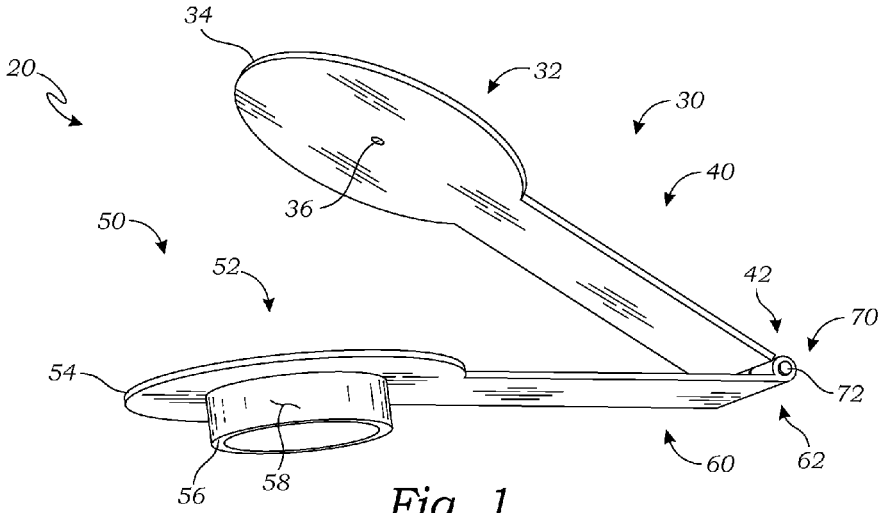
FIG. 1 is a perspective view of an exemplary toilet flange template apparatus in a first partially open configuration, in accordance with at least one embodiment.

Turning now to FIG. 1, there is shown a perspective view of an exemplary embodiment of a toilet flange template apparatus 20. The apparatus 20 comprises, in one embodiment, a first arm 30 and a second arm 50 connected at a hinge 70. While a particular size and configuration of the apparatus 20 and particular shapes of its components are shown and described herein, it will be appreciated by those skilled in the art that numerous other configurations, means and modes of operation, and related sizes and materials of construction, both now known or later developed, may be employed in the toilet flange template apparatus 20 without departing from the spirit and scope of the invention. Relatedly, while the invention is presented in the exemplary context of cutting flooring around a toilet flange, it will be appreciated that a similar device and method can be employed in other contexts where flooring or other surface covering is to be cut and positioned around a known and substantially fixed obstruction.

Figure 2:
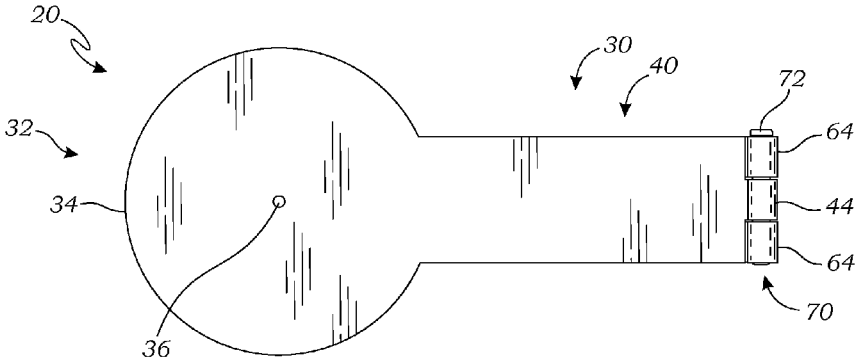
FIG. 2 is a top view thereof in a second substantially closed configuration, in accordance with at least one embodiment.
Figure 3:
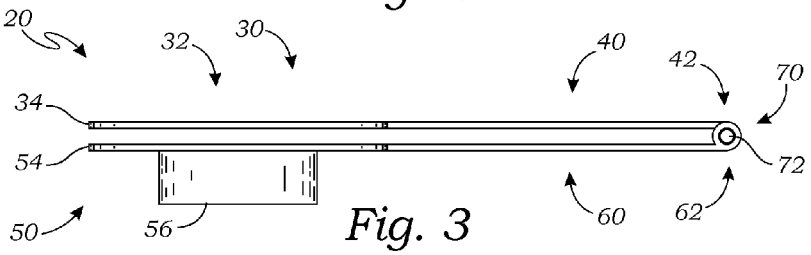
FIG. 3 is a side view thereof in the second substantially closed configuration, in accordance with at least one embodiment.
Figure 4:
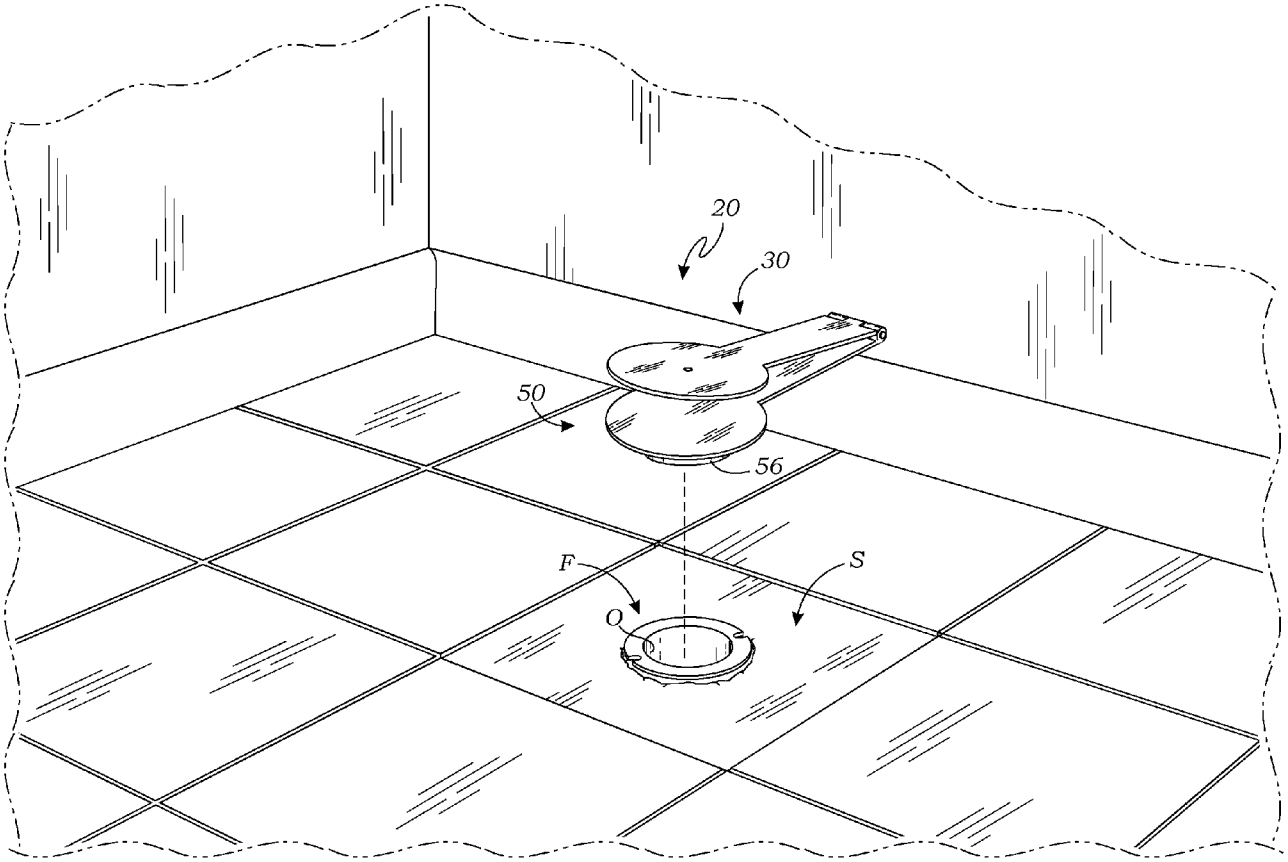
FIG. 4 is a partially exploded perspective view, in reduced scale, of the apparatus of FIG. 1 as installed in a first mode of operation, in accordance with at least one embodiment.

In a bit more detail, with continued reference to FIG. 1 and now with reference to the top and side views of FIGS. 2 and 3, the toilet flange template apparatus 20 is again shown in its exemplary embodiment as essentially comprising two pivotally connected first and second arms 30, 50. The upper first arm 30 is formed having a substantially round first head 32 having extending substantially radially therefrom a first connecting member 40. The first head 32 thus defines a substantially round or arcuate first perimeter edge 34 and is in the exemplary embodiment configured so as to approximate though be somewhat larger than the typical toilet flange F (FIG. 4). Specifically, in the case of a conventional toilet flange F rated as a "4×3 flange," meaning that the connector at the top side of the flange F that actually connects to the toilet is a nominal four inches (4") in diameter while the bottom diameter of the pipe is three inches (3"), which flange thus has a nominal outside diameter on the top or exposed side of seven inches (7") at its widest point, the first head 32 has a nominal outside diameter as defined by the first perimeter edge 34 of seven and three-eighths (7⅜"), thus providing an approximate three-eighths inch (⅜") overlap or increased size of the first head 32 relative to the toilet flange F, or an approximate three-eighths inch (⅜") clearance between an opening or hole H cut in a tile T (FIGS. 10 and 11) based on the template's first head 32, assuming the cut is made substantially along the line marked based on the template first head 32 by a blade that is approximately three-sixteenths inch (3⁄16") thick, which operational sequence is shown and described further below in connection with FIGS. 4-11. Preferably, the first head 32 will in the exemplary embodiment have a diameter of at least approximately three-sixteenth inch (3⁄16") greater than the largest outside dimension of the toilet flange F so as to provide at least a three-sixteenth inch (3⁄16") clearance about the flange. Once again, it will be appreciated that such dimensions and clearances are merely illustrative of features and aspects of the present invention and are non-limiting, as for example different toilet flange sizes or different or more generous clearances between the template first head 32 and the resulting hole H (FIGS. 10 and 11) relative to the toilet flange F (FIG. 4) are possible without departing from the spirit and scope of the invention. Accordingly and relatedly, none of the drawings are to be taken as or assumed to be "to scale." As shown particularly in FIGS. 1 and 2, the first head 32 is further formed having a first center hole 36 formed therein so as to communicate therethrough, more about which will be said below in connection with the apparatus 20 in use. At the first distal end 42 of the first connecting member 40, or at the end of the connecting member 40 opposite the first head 32, there is formed a first hinge member 44, here configured as an annular walled formation substantially centered on the first distal end 42 of the connecting member 40 with a central opening therethrough (not shown).

Similarly, the lower second arm 50 is formed having a substantially round second head 52 having extending substantially radially therefrom a second connecting member 60. The first head 52 thus defines a substantially round or arcuate second perimeter edge 54 that in the exemplary embodiment is configured to approximate the first perimeter edge 34. However, those skilled in the art will appreciate, particularly in connection with the discussion of the apparatus 20 in use as shown in FIGS. 4-11, that while the second head 52 is thus shown as substantially mirroring the first head 32 that is not necessary, and the second head 52 can take a number of other configurations without departing from the spirit and scope of the invention. At the second distal end 62 of the second connecting member 60, or at the end of the connecting member 60 opposite the second head 52, there is formed a second hinge member 64, here configured as a pair of offset annular walled formations spaced apart along the second distal end 62 of the connecting member 60 with a central opening therethrough (not shown), such that when the first and second arms 30, 50 are to be joined in a pivotal arrangement as shown, the first hinge member 44 of the first connecting member 40 is simply placed between the second hinge member 64 of the second connecting member 60 and a pin 72 passed through the first and second hinge members 44, 64 in a manner known in the art to form and define the functional hinge 70. It will be appreciated by those skilled in the art that any other pivot or hinge mechanism or means now known or later developed may be employed in the present invention without departing from its spirit and scope. Relatedly, even the configurations of the respective first and second connecting members 40, 60 in terms of their sizes and being integral with the respective first and second heads 32, 52 and the first and second hinge members 44, 64 is exemplary and is to be understood as merely illustrative of features and aspects of the present invention and non-limiting. With particular reference to FIGS. 1 and 3, the second arm 50 is also characterized in the exemplary embodiment by having a downwardly-extending substantially annular second centered boss 56 that is configured to enter and thus locate the apparatus 20 within the toilet flange F, more about which will again be said below in connection with the device in use as shown in FIGS. 4-11. Staying with the exemplary "4×3 flange," the second centered boss 56 is formed in the illustrated embodiment such that the boss outer surface 58 has a nominal outside diameter of three and seven-eighths inches (3⅞") and a length of approximately two inches (2") so as to substantially fit within the upper flange opening O again having a nominal inside diameter of four inches (4"). In any event, it is preferable that the clearance between the outer surface 58 of the second centered boss 56 and any flange opening O range from approximately a sixteenth inch to a quarter inch (1⁄16"-¼") so as to properly locate the remainder of the apparatus 20 relative to the flange F but allow for some clearance for ease of insertion and removal of the boss 56 and to account for variations among nominal flange sizes in the industry. Relatedly, it is preferable in the exemplary embodiment that the length of the second centered boss 56 be at least approximately one inch (1") in order to attain an adequate registration within the flange opening O.

With particular reference now to the side view of the exemplary toilet flange template apparatus 20 according to aspects of the invention shown in FIG. 3, it is shown that the overall lengths of the respective first and second arms 30, 50 are substantially equivalent as best appreciated while viewing the device in its substantially closed configuration. It can be seen that in such configuration the first and second arms 30, 50 are further substantially adjacent and parallel. In the exemplary embodiment and context of floor tiles, such tiles T (FIG. 4) having a nominal thickness of approximately three-eighths of an inch (⅜"), a corresponding approximately three-eighths of an inch (⅜") gap is thereby formed or left between the respective first and second arms 30, 50 when the apparatus 20 is in its substantially closed configuration, whereby a tile T positioned between the arms 30, 50, as shown particularly in FIG. 7, will have a substantially net fit arrangement, or result in both the first and second arms 30, 50 being substantially parallel and adjacent to opposite sides of the tile T. Continuing with an exemplary tile T, where such is up to a nominal twenty-one inch (21") square, it will be appreciated that no matter where the tile to be cut is positioned relative to the apparatus 20 and the toilet flange F and the surrounding tiles, assuming free rotation of the apparatus 20 within the flange F, if the apparatus 20 is to accommodate such a tile, the distance from the hinge 70 to particularly the first head 32 should be at least approximately seven inches (7") so as to position the head 32 virtually anywhere over the tile T, even at substantially the geometric center of the tile T. In the exemplary embodiment the length of the first and second connecting members 40, 60 is approximately eight inches (8"), yielding an overall length of the apparatus 20 in its substantially closed configuration of approximately fifteen and a half inches (15½") and thus putting the center of the first head 32, or the location of the first center hole 36, approximately eleven and a half inches (11½") from the hinge 70, or long enough to comfortably reach the center of even a 21-inch tile. Once more, those skilled in the art will appreciate that all such sizes, shapes, and configurations of the toilet flange template apparatus and its components are merely illustrative of the features and aspects of the present invention, such that numerous alternative configurations are possible without departing from the spirit and scope of the invention. In the exemplary embodiment of the apparatus 20 and assuming up to twenty-one inch (21") tiles are to be accommodated, it is preferable that the overall length of the apparatus 20 be at least fourteen inches (14"), assuming a roughly seven inch (7") first connecting member 40 length and a roughly seven inch (7") diameter first head 32, again, so as to accommodate any such tile and any location of the cut thereon corresponding to the flange location relative to where the tile or other flooring is to be installed. Again, it will be appreciated by those skilled in the art that the apparatus 20 can easily be scaled up or down depending on the size of tile to be accommodated and other factors. Notably, whatever the case, it is important, as will be appreciated further based on the below discussion of the apparatus in use, that the center of the upper first head 32, and particularly the first center hole 36, be substantially centered over the lower second head 52, and particularly the second center boss 56, no matter the sizes or configurations of the respective heads 32, 52 or connecting members 40, 60 when the apparatus 20 is in its substantially closed configuration as shown in FIG. 3.

Briefly, in terms of the construction of the exemplary toilet flange template apparatus 20, in one illustrative embodiment each component, namely the first and second arms 30, 50, may be of a unitary construction such as formed of a plastic such as ABS as through a molding process. In such a case, the arms 30, 50 may each be formed so as to be approximately one eighth of an inch (⅛") or perhaps slightly thicker. Regarding the first center hole 36 formed in the first head 32 and the second center boss 56 formed on the second head 52, such features may be formed simultaneously with the respective first and second arms 30, 50 or in secondary operations, such as by drilling the center hole 36 or separately molding or otherwise forming the second center boss 56 and then installing the boss 56 on the second head 52 as through solvent bonding, ultrasonic welding, or any other technique now known or later developed. More generally, those skilled in the art will appreciate that any appropriate material and method of fabrication or construction now known or later developed may be employed in forming the apparatus 20 according to aspects of the present invention without departing from its spirit and scope, such that the present configuration, including size and shape and material, is to be understood as expressly non-limiting and merely illustrative. To complete the exemplary assembly, once the first and second arms 30, 50 are formed, the pin 72 is simply inserted through the formed first and second hinge members 44, 64 so as to form the hinge 70 and thereby pivotally link the first and second arms 30, 50. Again, while a pinned hinge 70 is shown and described, any other such means of linking the first and second arms 30, 50 is possible without departing from the spirit and scope of the invention.

Figure 5:
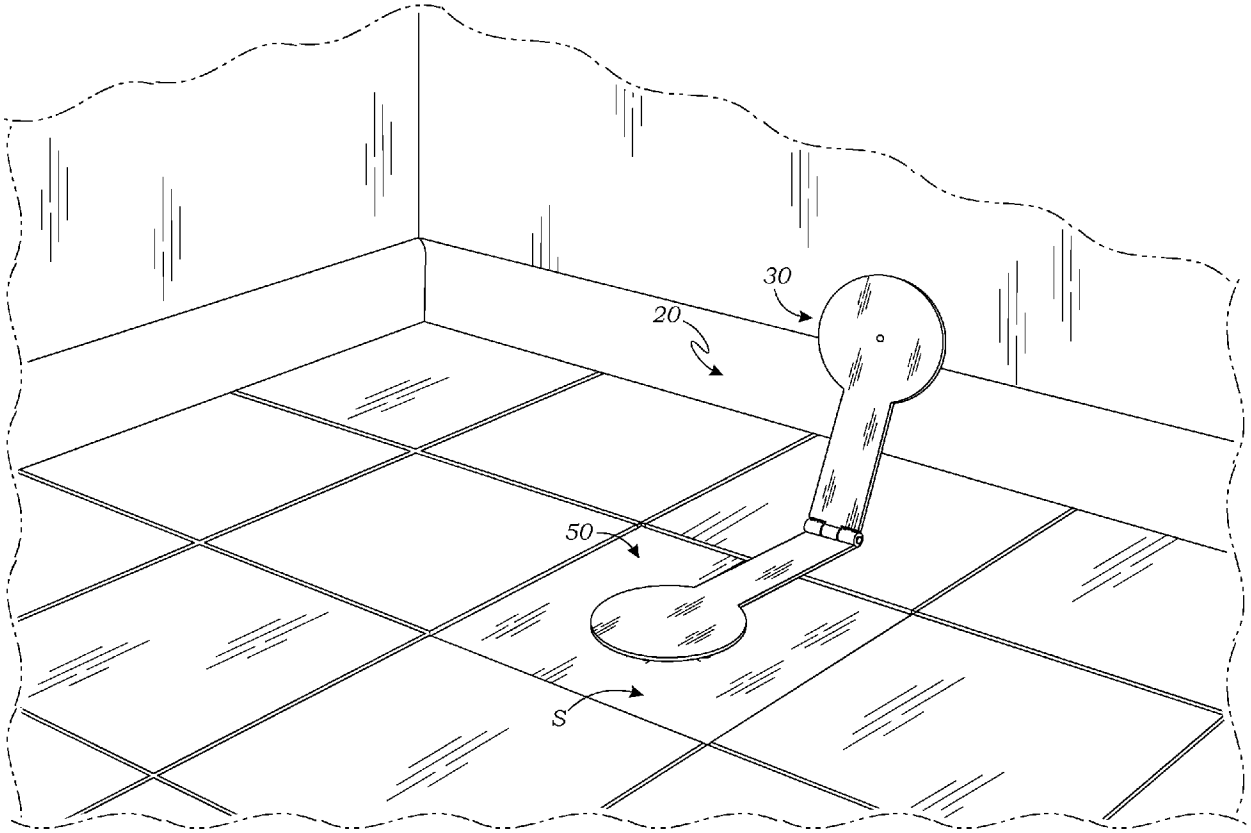
FIG. 5 is a perspective view thereof as installed in a second mode of operation, in accordance with at least one embodiment.
Figure 6:
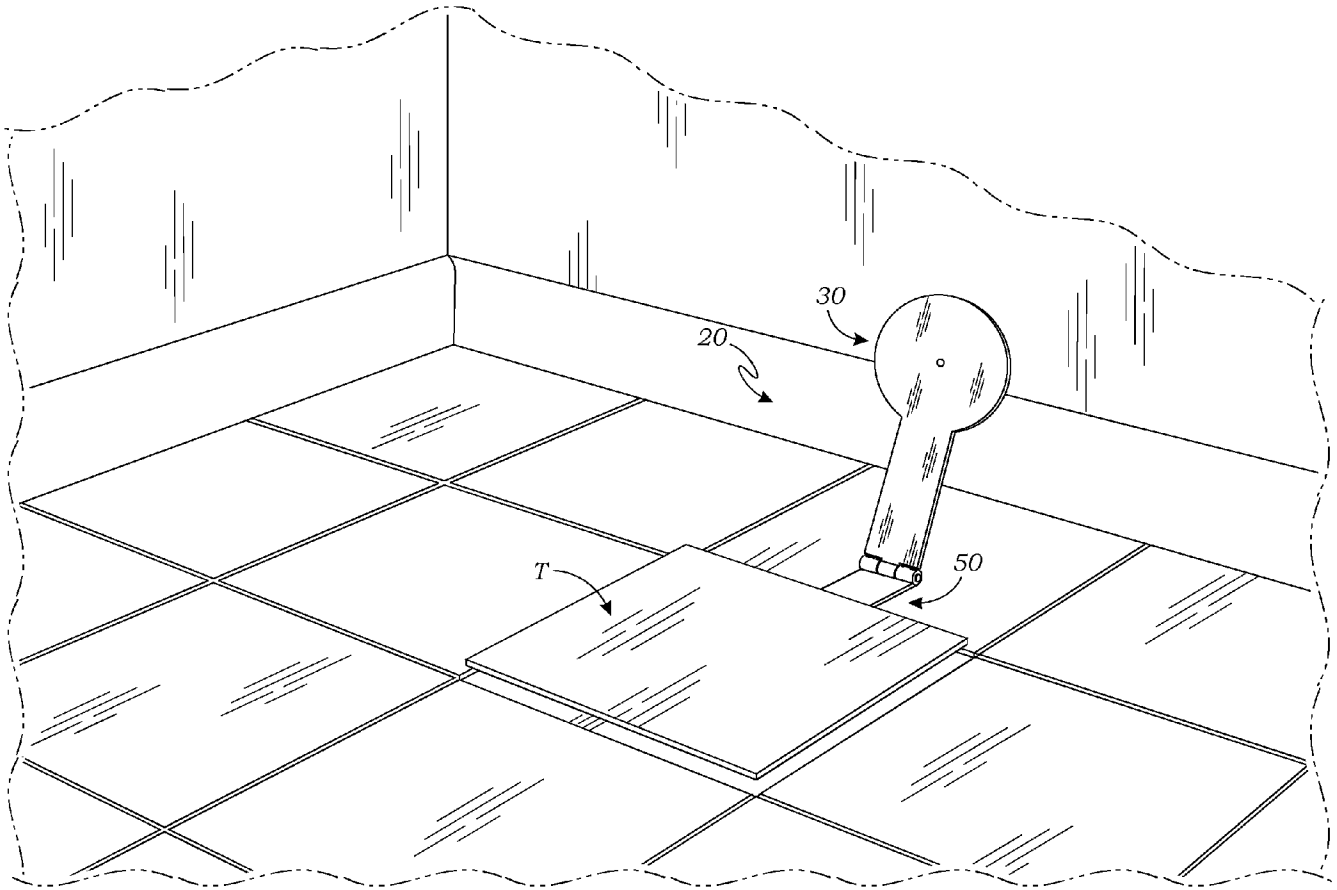
FIG. 6 is a perspective view thereof as installed in a third mode of operation, including an exemplary tile laid thereon, in accordance with at least one embodiment.
Figure 7:
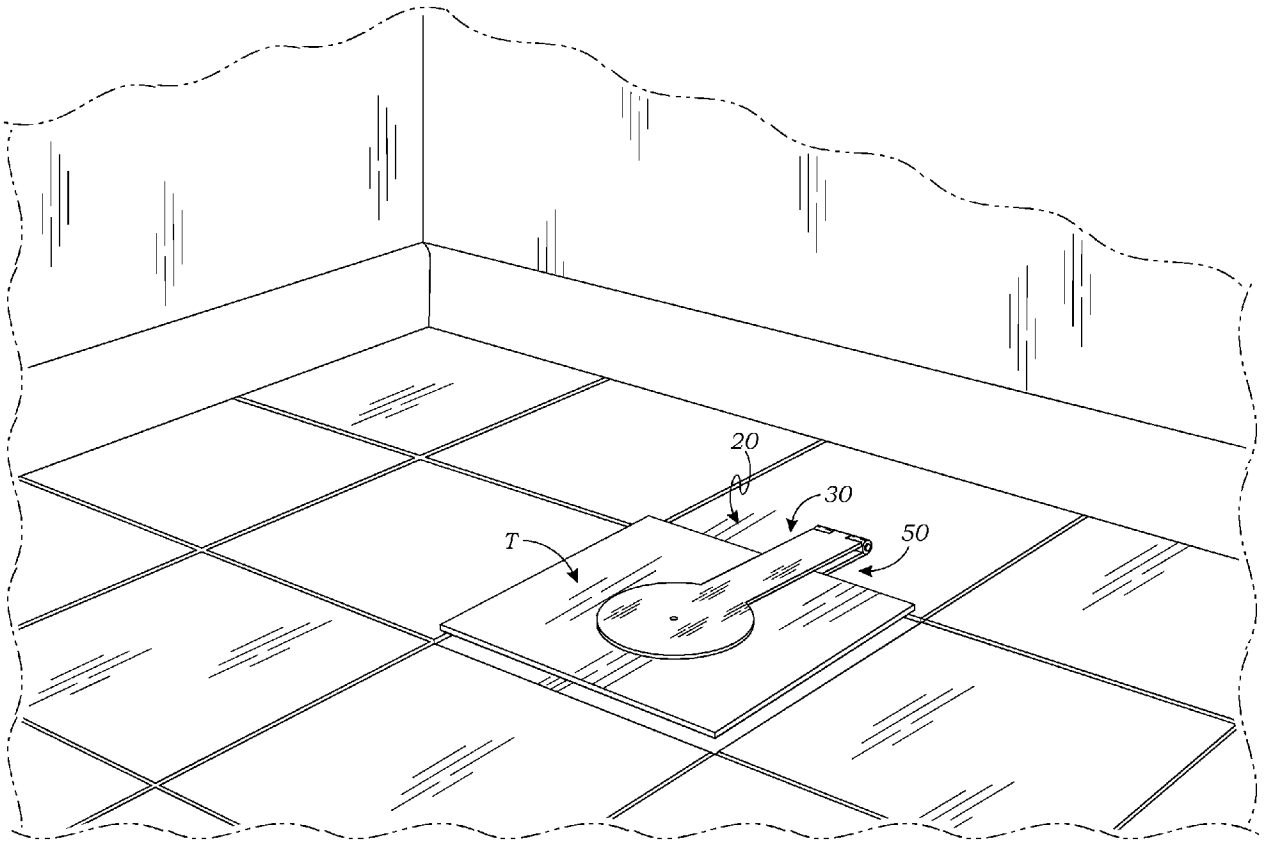
FIG. 7 is a perspective view thereof as installed in a fourth mode of operation, in accordance with at least one embodiment.
Figure 8:
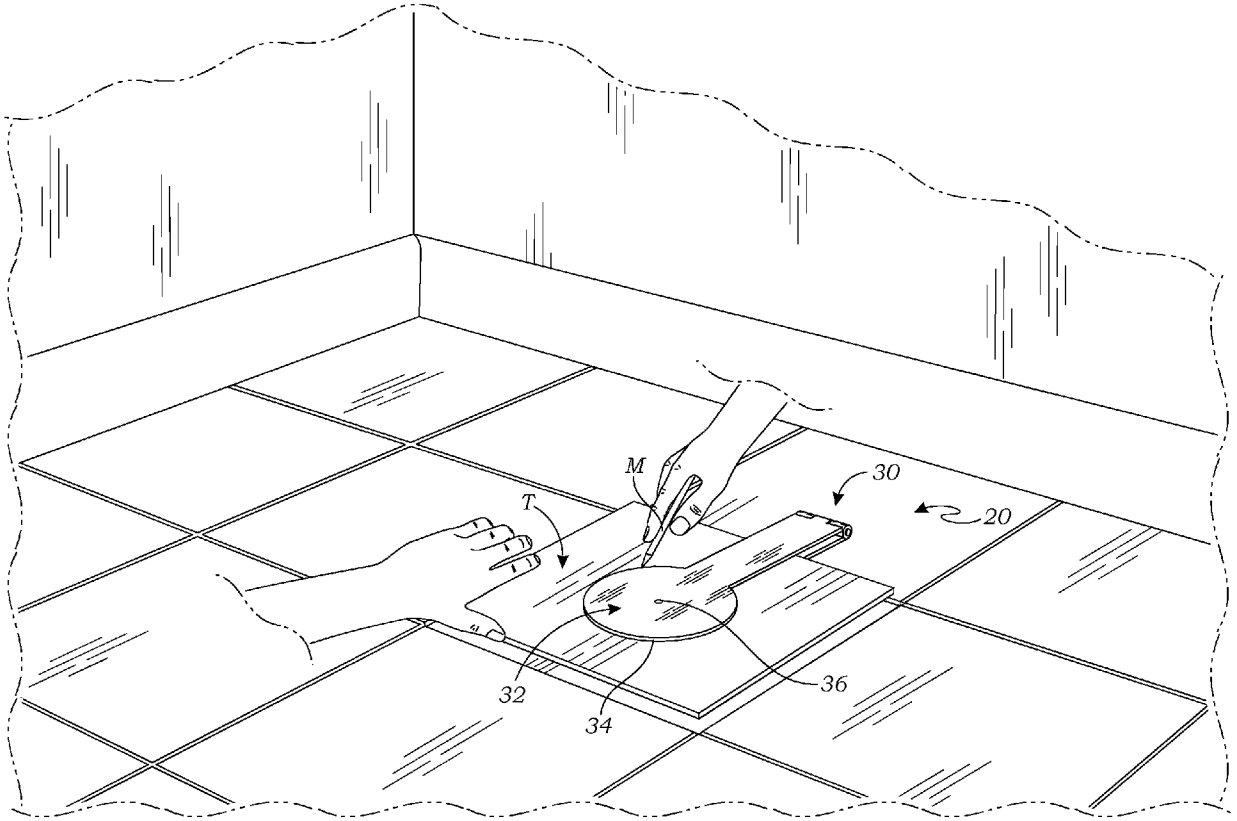
FIG. 8 is a perspective view thereof as installed in a fifth mode of operation, in accordance with at least one embodiment.
Figure 9:
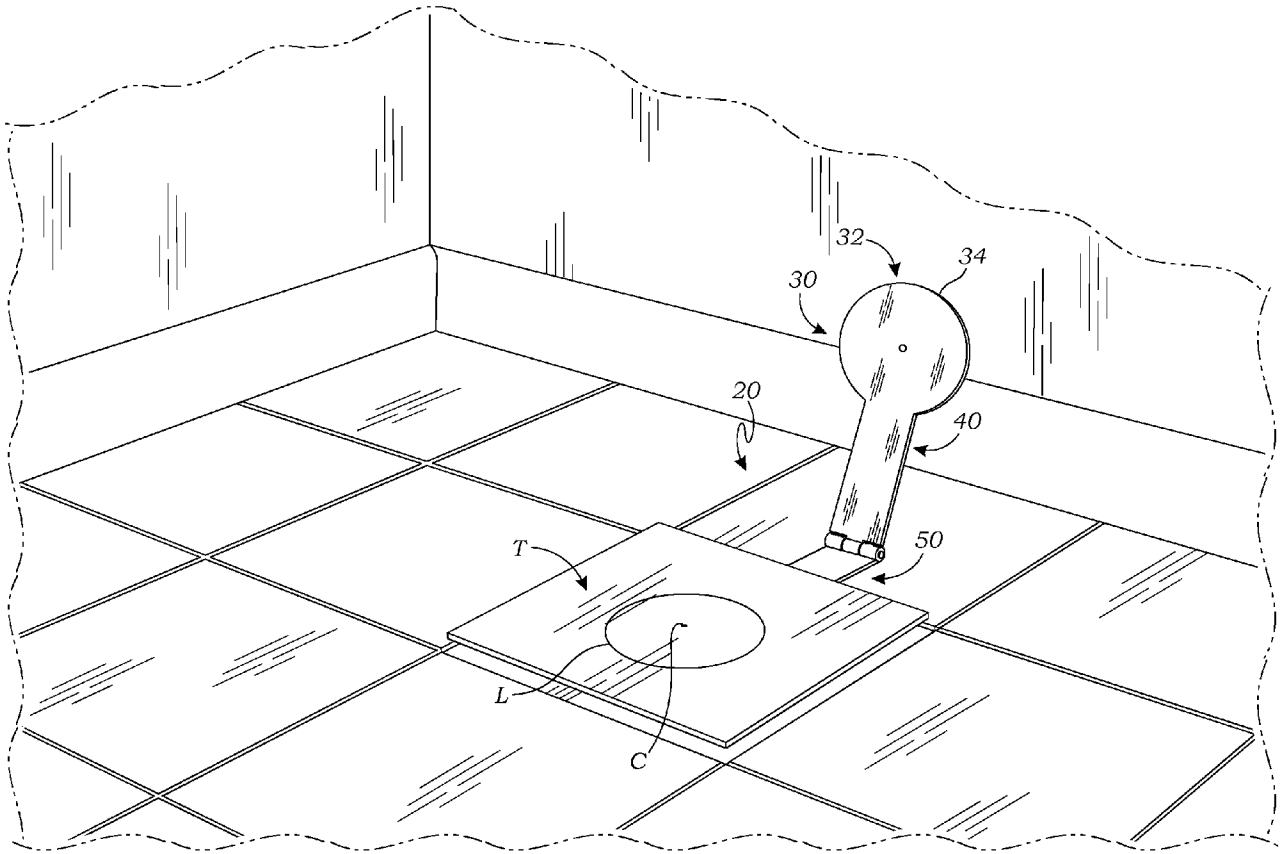
FIG. 9 is a perspective view thereof as installed in a sixth mode of operation, in accordance with at least one embodiment.
Figure 10:
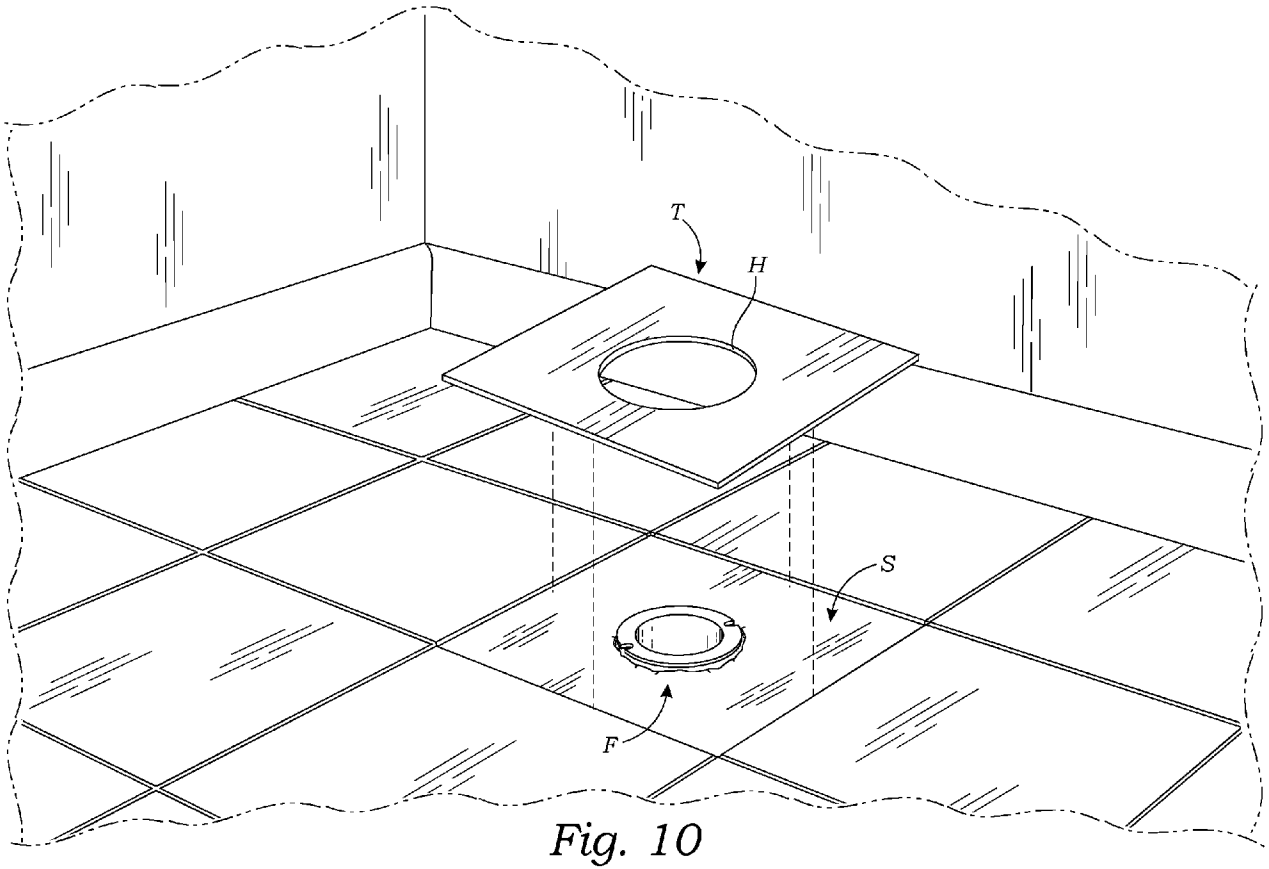
Fig. 10 Prior Art
FIG. 10 is an exploded perspective view of the cut tile being installed in a manner known in the art.
Figure 11:
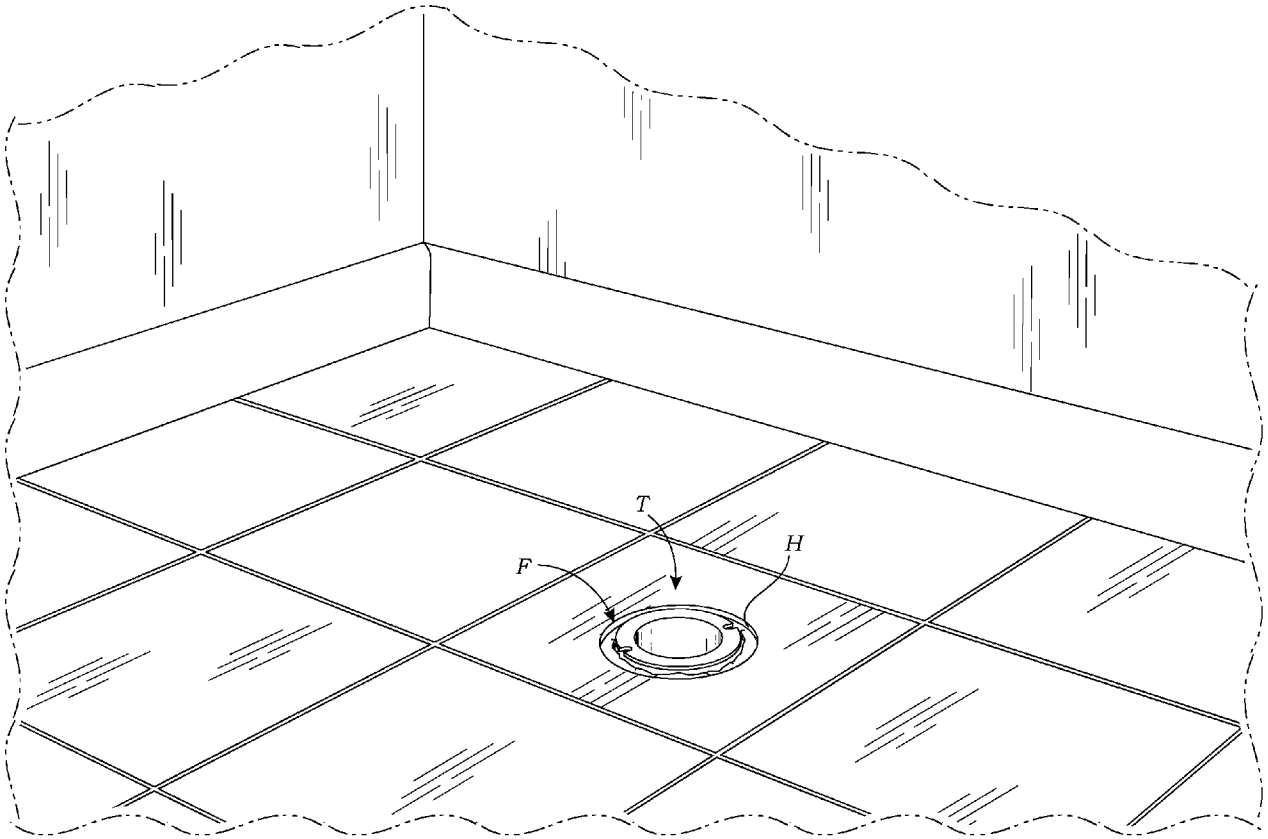
Fig. 11 Prior Art
FIG. 11 is a perspective view of the cut tile installed in a manner known in the art.

Turning now to FIGS. 4-11, in use in the exemplary context of installing tile in a bathroom or the like, the toilet flange template apparatus 20 according to aspects of the invention is to be employed in relatively efficiently, conveniently, and accurately determining a cut needed in the selected flooring material so as to then position and install such flooring around the toilet flange or the like. As shown in FIG. 4, there remains an opening in the tile flooring about the toilet flange F in which a tile T (FIG. 6) is to be installed on the subfloor S. As a first step, as shown in exploded fashion, the apparatus 20 is positioned over the flange F with the second center boss 56 oriented downwardly substantially over the toilet flange F so that the boss 56 may be inserted particularly within the opening O of the flange F. At this point the position of the first arm 30 relative to the second arm 50 is effectively irrelevant. Next, as shown in FIG. 5, the apparatus 20 is now positioned over the toilet flange F (FIG. 4) with the second center boss 56 located within the opening O (FIG. 4). It will be appreciated that the second arm 50, and particularly the second head 52 serves a separate function of blocking the toilet flange opening O (FIG. 4) so as to substantially prevent unwanted debris from entering therein during the flooring installation. The first arm 30 is shown as now being pivoted up and away from the second arm 50 that lies substantially parallel to the subfloor S, again, with the second center boss 56 located within the opening O of the flange F (FIG. 4), so as to be in a position to receive a tile T (FIG. 6) therebetween, or laid on the second arm 50 as shown in FIG. 6. Particularly, as shown in FIG. 6, the tile T that is ultimately to be installed on the subfloor S about the toilet flange F (FIG. 4) is placed immediately over and substantially adjacent the lower second arm 50 of the apparatus 20 and positioned thereon in substantially the location the tile T is to be installed relative to the other flooring. In such position, as shown in FIG. 7, the next step is to pivot the first arm 30 back down so as to be immediately over and substantially adjacent the tile T, which in the exemplary embodiment is to place the apparatus 20 substantially in the closed configuration as shown in FIG. 3 with the tile T effectively sandwiched between the first and second arms 30, 50, again positioned where desired over the toilet flange F (FIG. 4). Those skilled in the art will appreciate, however, that rather than pivoting the first arm 30 up and away as in FIGS. 5 and 6 and then back down as in FIG. 7, it would effectively be just as easy and perhaps even preferable in some contexts to simply slip the tile T in between the first and second arms 30, 50 even while in a substantially closed configuration of the apparatus 20 as shown in FIGS. 3 and 7. In any event, once the tile T is thus positioned within the apparatus 20, now with reference to FIG. 8, a writing implement, scribe, or other such tool M for marking the surface of the tile T may be used to trace the perimeter edge 34 of the head 32 of the upper or exposed first arm 30. It will be appreciated by those skilled in the art that in so doing, due to the location of the apparatus 20, and thus the first arm 30, relative to the toilet flange F (FIG. 4) based on the engagement of the downwardly-extending second center boss 56 of the second arm 50 within the flange opening O (FIG. 4), the arcuate or curved line L (FIG. 9) resulting on the surface of the tile T corresponds to the clearance cut to be made in the tile T substantially corresponding to and clearing the flange F. It will be further appreciated that in this context it is effectively irrelevant the size and shape of the second head 52 (FIG. 1) since the tile T is only being marked and will later be cut when removed from the apparatus 20. In other contexts, though, the flooring, such as linoleum or the like, might be cut in place employing the apparatus 20 as a cutting template, in which case the second head 52 approximating the first head 32 is advantageous. In any event, it is desirable that the size and shape of the second head 52 at least accommodate the second center bore 56 and also allow for a flush seating over the flange F (FIG. 4), which again has the further advantage of helping to prevent unwanted debris from entering the opening O of the toilet flange F (FIG. 4). Thus, it is preferable in the exemplary embodiment that the diameter of the second head 52 be at least that of the toilet flange opening O, which it will be appreciated would result in the second head 52 being smaller than the first head 32 rather than the two being the same size as shown in FIGS. 1-3. In FIG. 9, the first arm 30 is shown as again having been pivoted up and away from the tile T and the second arm 50, with the line L that was marked previously on the surface of the tile T now being visible. Those skilled in the art will appreciate that while the line L is shown as being a complete circle, such could not be traced in its entirety about the perimeter edge 34 of the first head 32 in the exemplary embodiment due to the first connecting member 40. However, in an alternative embodiment (not shown), the first connecting member 40 could be joined more centrally to the first head 32 and bent upwardly at its middle section to form a handle of sorts and thereby provide clearance about substantially the entire perimeter of the first head 32. Or, utilizing the first center hole 36 formed in the first head 32, the marking tool M (FIG. 8) could be employed with the apparatus 20 in the closed position over the tile T as shown in FIG. 7 to also mark the center location C of the hole H (FIG. 10) to be cut; then, when the first arm 30 is pivoted up and away, a compass or other such tool (not shown) could be used to complete the circular line L by taking advantage of the marked center location C. Or, the small portion of the circular line L not directly traced around the perimeter edge 34 of the first head 32 could simply be completed "by hand" after the first arm 30 is pivoted up and out of the way or the tile T is otherwise removed from the apparatus 20. Again, it will be appreciated that the tile T can be inserted in or removed from the apparatus 20 with or without pivoting, in whole or in part, the first arm 30 relative to the second arm 50. Finally, with reference to FIGS. 10 and 11 showing what is from that point the conventional approach to installing a properly cut tile T, the tile T with the hole H cut therein using any appropriate equipment, tool, or technique now known or later developed as substantially corresponding to the line L (FIG. 9) as marked on the tile T as above-described is first positioned over the location the tile T is to be installed and is then in fact installed about the toilet flange F as shown. Once again, those skilled in the art will appreciate that the toilet flange template apparatus 20 according to aspects of the present invention substantially facilitated convenient and effective marking of the proper size and location of the hole H relative to the toilet flange F, rendering the device functionally useful and beneficial.

To summarize, regarding the exemplary embodiments of the present invention as shown and described herein, it will be appreciated that a toilet flange template apparatus is disclosed and configured for locating a portion thereof substantially centered on the toilet flange even when a tile is placed over the toilet flange so as to thereby enable relatively convenient and accurate marking of a hole cut-out location on the tile substantially corresponding to and providing clearance about the toilet flange. Because the principles of the invention may be practiced in a number of configurations beyond those shown and described, it is to be understood that the invention is not in any way limited by the exemplary embodiments, but is generally directed to a toilet flange template apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A toilet flange template apparatus comprising:

a first arm having a first head and a first connecting member extending therefrom, the first head defining a first perimeter edge substantially corresponding to and providing circumferential clearance relative to a toilet flange; and a second arm having a second head and a second connecting member extending therefrom, the second arm being pivotally connected to the first arm, the second head formed having a substantially downwardly-extending second center boss configured to be received within the toilet flange;

whereby in use of the apparatus positioning the second center boss within the toilet flange and placing a tile between the first and second arms in a desired location on a subfloor enables marking the tile along the first perimeter edge so as to define a hole to be cut in the tile substantially corresponding to and providing circumferential clearance relative to the toilet flange for subsequent installation of the tile thereabout.

2. The apparatus of claim 1 further comprising a first center hole formed substantially centrally in the first head.

3. The apparatus of claim 1 further comprising a hinge incorporated into the first and second connecting members for pivotally connecting the first and second arms.

4. The apparatus of claim 3 wherein:

the first arm is formed at a first distal end opposite the first head with a first hinge member;

the second arm is formed at a second distal end opposite the second head with a second hinge member configured to functionally engage the first hinge member; and a pin is inserted substantially within the first and second hinge members to form the hinge.

5. The apparatus of claim 4 wherein the hinge defines a distance between the first and second arms in a substantially closed configuration of the apparatus of approximately three-eighths of an inch (3/8").

6. The apparatus of claim 1 wherein the second head defines a second perimeter edge substantially corresponding to the toilet flange, whereby the second head helps prevent unwanted debris from entering the toilet flange when the second center boss is positioned therein.

7. The apparatus of claim 6 wherein the first and second perimeter edges substantially correspond.

8. The apparatus of claim 7 wherein the first and second heads have a diameter of at least three-sixteenths inch (3/16") greater than that of the toilet flange.

9. The apparatus of claim 6 wherein the first head has a diameter of at least three-sixteenths inch (3/16") greater than that of the toilet flange and the second head has a diameter of at least that of an opening of the toilet flange.

10. The apparatus of claim 1 wherein the apparatus has an overall length of at least approximately fourteen inches (14").

11. The apparatus of claim 1 wherein the second centered boss has a diameter ranging from approximately a sixteenth inch to a quarter inch (1/16"-1/4") smaller than that of an opening of the toilet flange.

12. The apparatus of claim 11 wherein the second centered boss is at least approximately one inch (1") long.

13. A toilet flange template apparatus comprising:

a first arm having a first head and a first connecting member extending therefrom, the first head defining a first perimeter edge substantially corresponding to and providing circumferential clearance relative to a toilet flange; and a means for locating the first head substantially centered on the toilet flange when a tile is placed over the toilet flange, whereby in use of the apparatus placing the tile between the first arm and the toilet flange in a desired location on a subfloor enables marking the tile along the first perimeter edge so as to define a hole to be cut in the tile substantially corresponding to and providing circumferential clearance relative to the toilet flange for subsequent installation of the tile thereabout.

14. The apparatus of claim 13 wherein the locating means comprises a second arm having a second head and a second connecting member extending therefrom, the second arm being pivotally connected to the first arm, the second head formed having a substantially downwardly-extending second center boss configured to be received within the toilet flange, whereby further in use of the apparatus the second center boss is positioned within the toilet flange and the tile is placed between the first and second arms.

15. A toilet flange template apparatus comprising:

a first arm having a first head and a first connecting member extending therefrom, the first head defining a first perimeter edge substantially corresponding to and providing circumferential clearance relative to a toilet flange, the first head having a diameter of at least three-sixteenths inch (3/16") greater than that of the toilet flange; and a second arm having a second head and a second connecting member extending therefrom, the second arm being pivotally connected to the first arm, the second head formed having a substantially downwardly-extending second center boss configured to be received within the toilet flange, the second center boss having a diameter ranging from approximately a sixteenth inch to a quarter inch (1/16"-1/4") smaller than that of an opening of the toilet flange and having a length of at least approximately one inch (1");

whereby in use of the apparatus positioning the second center boss within the toilet flange and placing a tile between the first and second arms in a desired location on a subfloor enables marking the tile along the first perimeter edge so as to define a hole to be cut in the tile substantially corresponding to and providing circumferential clearance relative to the toilet flange for subsequent installation of the tile thereabout.

* * * * *